US010634453B1

(12) United States Patent
Spuhr

(10) Patent No.: US 10,634,453 B1
(45) Date of Patent: Apr. 28, 2020

(54) REFLECTOR SIGHT SYSTEM

(71) Applicant: Spuhr i Dalby AB, Löddeköpinge (SE)

(72) Inventor: Håkan Spuhr, Dalby (SE)

(73) Assignee: Spuhr i Dalby AB, Loddekopinge (SE)

( * ) Notice: Subject to any disclaimer, the term of this patent is extended or adjusted under 35 U.S.C. 154(b) by 0 days.

(21) Appl. No.: 16/391,880

(22) Filed: Apr. 23, 2019

(51) Int. Cl.
*F41G 1/30* (2006.01)
*F41G 11/00* (2006.01)

(52) U.S. Cl.
CPC ..... *F41G 1/30* (2013.01); *F41G 11/003* (2013.01)

(58) Field of Classification Search
CPC ..... F41G 1/30; F41G 11/003
USPC ..... 42/113, 124–128
See application file for complete search history.

(56) References Cited

U.S. PATENT DOCUMENTS 9,417,034 B1 * 8/2016 Swan ..... F41G 11/008

* cited by examiner

*Primary Examiner* — Samir Abdosh
(74) *Attorney, Agent, or Firm* — Renner, Otto, Boisselle & Sklar, LLP

(57) ABSTRACT

A sight system (10) for a firearm (12) is proposed. The sight system comprises: a sight mount (14) configured to be attached to the firearm (12), a first reflector sight (16) mounted on the sight mount (14) and producing a first aim point/image, and a second reflector sight (18) mounted on the sight mount (14) and producing a second aim point/image. The second reflector sight (18) is positioned in front of and aligned with the first reflector sight (16), and the first aim point/image and the second aim point/image are visible through the first reflector sight (16). The firearm (12) has a first mode of operation and a second mode of operation, and: the first reflector sight (16) is calibrated with respect to the first mode of operation, and the second reflector sight (18) is calibrated with respect to the second mode of operation.

11 Claims, 6 Drawing Sheets

REFLECTOR SIGHT SYSTEM

TECHNICAL FIELD

The proposed technology relates generally to the field of sighting systems for firearms. The proposed technology relates specifically to the field of reflector sights.

BACKGROUND

A reflector sight is an optical device allowing a shooter to look through a glass element and see a reflection of an illuminated aiming point or image that is superimposed on the field of view. A common design is a red-dot sight using a red Light-Emitting Diode (LED) at the focus of collimating optics. The LED generates an illuminated reticle in the form of a dot. The dot indicates a sightline that is in alignment with the weapon the sight is attached to. This way the reflector sight is close to parallax free and insensitive to eye position. Another example is a holographic diffraction sight that provides a holographic reticle image on glass window that is superimposed at a distance on the field of view.

Reflector sights generally fall into two categories, closed sights and open sights. The closed sights typically have a housing of a roughly tubular shape containing the optics. The ends of the closed sights are typically closed by transparent windows preventing direct access to the optics. Dust covers can typically be fitted at the ends. Different filters, such as polarizing filters, can be fitted on the closed sight. Open sights typically has a flat base and a single supporting loop extending from the base and holding the reflective optics. This type of reflector sights does not have a housing protecting the optics from direct access.

Most reflector sights have an adjustable brightness of the reticle. The adjustment can be passive or active.

It is common that Light Machine Guns (LMG), General-Purpose Machine guns (GPMG), and Heavy Machine Guns (HMG) have barrels with quick-change capability. The barrel is typically mounted in a trunnion, which in turn is mounted in a receiver. A hand-operated lever or the like typically unlocks the barrel and the shooter can push it forward and remove it from the trunnion. A carrying handle is typically fixed to the barrel making it easier to handle when changing the barrel. It is not uncommon that trained soldiers can change the barrel in less than 10 seconds, or even in less than 7 seconds. Examples of a LMG, a GPMG, and a HMG that are configured for a quick barrel change is the FN Minimi, the FN MAG, and Browning M2A1.

Different barrels mounted in the same firearm may produce different groupings when shooting at the same distance and with ammunition of the same make and type. The mean positions or geometric center of the different groupings may be shifted horizontally and/or vertically with respect to one another. This means that different barrels produce different groupings, which typically has a negative impact on the accuracy of the weapon system as a whole. For example, if a firearm has two interchangeable barrels configured for a quick barrel change, a shooter may adjust the sights such that the sight line falls between the geometric centers of the two different groupings produced by the two barrels. This can have a severe impact on the accuracy when shooting. Alternatively, the shooter could reset the sights after each barrel change. However, this takes time and involves test shooting, which typically requires a shooting range.

Object

The proposed technology aims at obviating the aforementioned disadvantages and failings of previously known technologies. In particular, it is an object of the invention to provide a technology improving the accuracy of weapon systems that can operate in different modes, such as with different barrels.

SUMMARY

In a first aspect of the proposed technology a sight system, or sighting system, for a firearm is provided. The sight system comprises: a sight mount configured to be attached to the firearm, a first reflector sight mounted on the sight mount and producing a first reticle, and a second reflector sight mounted on the sight mount and producing a second reticle. The second reflector sight is positioned in front of and aligned with the first reflector sight, and the first reticle and the second reticle are visible through the first reflector sight. Here, a reticle is understood to encompass an aim point/image.

The proposed technology allows for an accurate shooting with a firearm having two different setups or modes of operation producing different groupings, or groupings having different mean positions at a specific distance. Here, a mean position is understood to encompass the mean point of impact of the grouping. A first setup may be with a first barrel and a second setup may be with a second barrel, either of the same type or of different types. Alternatively, a first setup may be with a first type of ammunition and a second setup may be with a different second type of ammunition. In yet one alternative, a first setup may be without a silencer mounted on the barrel and a second setup may be with a silencer mounted on the barrel.

A reflector sight is understood to encompass optical devices that allow the shooter to look through a glass element and see a reflection of an illuminated aiming point or image superimposed on the field of view. For example, the reflector sight may be a holographic diffraction sight providing a holographic reticle image on glass window that is superimposed at a distance on the field of view.

It is understood that when mounted on the sight mount, the first and second reflector sights are fixed relative to one another. It is also understood that the first and second reflector sights are oriented for shooting in the same general direction.

Here, the terms "in front of" and "behind" are understood to be from the perspective, or relative, to the shooter operating the firearm, which means that the first reflector sight is closer to the shooter than the second reflector sight, and that the first reflector sight is positioned before the second reflector sight along the sightline starting at the shooter.

The second reflector sight being aligned with the first reflector sight means that the sightline of a shooter passes through both reflector sights, and that the optical axes of the first and second reflector sights are oriented in the same general direction.

It is understood that the sight mount can be releasably attached to the firearm. The sight mount may be adjustable and comprise a lower part, an upper part, and a selector. The lower part is configured to be attached to the firearm, and the upper part is pivotally connected to and biased with respect to, or away from, the lower part. The selector is configured to set the upper part at different angular positions relative to the lower part corresponding to different shooting distances. In this setup, the first reflector sight and second reflector sight are mounted on the upper part.

These features allows for the sight mount to compensate for varying shooting distances, while the two reflector sights can be used for compensating for changes in setup or mode of operation of a firearm. Such multi-parameter adjustments are not possible using only two reflector sights, or an adjustable sight mount with a single reflector sight. Here, the terms "lower" and "upper" are understood as relative to the firearm, which means that the lower part is closer to the firearm than the upper part.

The firearm may have a first setup, or mode of operation, and a second setup, or mode of operation. The first reflector sight may be calibrated with respect to the first setup, or mode of operation, and the second reflector sight may be calibrated with respect to the second setup, or mode of operation.

For example, the first and second setups, or modes of operation, may produce different groupings, or groupings having different mean positions at a specific distance. The first reflector sight may be calibrated with the first aim point/image centered on the first grouping. Similarly, the second reflector sight may be calibrated with the second aim point/image centered on the second grouping. Here, centered on the grouping is understood to encompass the aim point/image being adjusted or set to fall at, or overlap, the mean positions or geometric center of the grouping.

The first setup may be with a first type of ammunition and the second setup may be with a different second type of ammunition. The first ammunition type may have ballistic properties that differ from the ballistic properties of the second ammunition type when fired by the firearm. The first ammunition type may produce muzzle velocities in a first range and a second ammunition type may produce muzzle velocities in a second range. The mean muzzle velocity of the first range may be different from the mean muzzle velocity of the second range. The mean muzzle velocity of the first range may be 10% to 60%, or 20% to 40%, greater than the mean muzzle velocity of the second range. The first range and the second range may be disjoint or non-overlapping. The first type of ammunition may be supersonic when fired by the firearm, and the second type of ammunition may be subsonic when fired by the firearm. The proposed technology thus allows for quick change of ammunition type under field conditions with a reduced negative effect on the accuracy.

The firearm may be configured for a barrel change, or a quick barrel change, between a first barrel and a second barrel. The first setup, or mode of operation, may be with the first barrel fitted on the firearm, the second setup, or mode of operation, may be with the second barrel fitted on the firearm.

The first barrel may produce a first grouping and the second barrel may produce a second grouping, for example when shooting ammunition of the same make and type at a known or specific distance. In this application of the proposed technology, the firearm may be a LMG, GPMG, or a HMG, or an assault rifle. The firearm being configured for a quick barrel change is understood to encompass the barrel change being possible or convenient in the field and under operative conditions, for example to avoid overheating in extended firing.

The sight system may further comprise: a tubular seal connecting the first reflector sight and the second reflector sight and configured to prevent light, dirt and/or water from entering there between.

In a second aspect of the proposed technology a use of a sight system according to the first aspect of the proposed technology is suggested for compensating for a change of setup, or mode of operation. Different setups, or modes of operation, are described above.

In a third aspect of the proposed technology a firearm is provided fitted with a sight system according to the first aspect of the proposed technology. The firearm and the sight system may comprise any of the features described elsewhere in the specifications. The firearm and the sight system may be regarded as a weapon system comprising the firearm and the sight system.

In a fourth aspect of the proposed technology a use of firearm according to the third aspect of the proposed technology is suggested.

In a fifth aspect of the proposed technology a tubular seal is provided for a sight system according to the first aspect of the proposed technology. The tubular seal connects the first reflector sight and the second reflector sight and is configured to prevent light, dirt and/or water from entering there between. The tubular seal may comprise any of the features described elsewhere in the specifications.

In a sixth aspect of the proposed technology a use of a seal according to the third aspect tubular seal is suggested.

In a seventh aspect of the proposed technology a method is provided for calibrating a sight system according to the first aspect of the proposed technology when mounted on a firearm having a first setup, or mode of operation, and a second setup, or mode of operation. The method comprises: calibrating the first reflector sight with respect to the first setup, or mode of operation, and calibrating the second reflector sight with respect to the second setup, or mode of operation. Examples of different setups or modes of operation are described above. The sight mount and firearm may comprise any of the features described elsewhere in the specifications.

In an eighth aspect of the proposed technology a use of a sight mount is proposed. The sight mount is configured to be attached to a firearm for mounting a first reflector sight producing a first aim point/image and a second reflector sight producing a second aim point/image. The second reflector sight is positioned in front of and aligned with the first reflector sight. The first aim point/image and the second aim point/image are visible through the first reflector sight. The sight mount and firearm may comprise any of the features described elsewhere in the specifications.

DETAILED DESCRIPTION

The first and the second reflector sights may be non-magnifying. Alternatively, the first reflector sigh may be magnifying and the second reflector sight may be non-magnifying. Each of the first and second reflector sight may produce a single aim point/image. The first and second reflector sights may be permanently mounted on the sight mount. Alternatively, the first and second reflector sights may be releasably mounted on the sight mount.

The first reflector sight and the second reflector sight may be operationally independent from one another. This means that the first reflector sight can be operated or activated simultaneous to the second reflector sight being deactivated, and vice versa. Additionally, if the reflector sights are releasably connected to the sight mount, one of the reflector sights can be removed from the sight system, for example when damaged or when in need of service, and the remaining reflector sight can still be used.

The first reflector sight and the second reflector sight may produce aim points/images that are different. For example the aim points/images may have different colors, shapes, and/or intensities. For example, the first reflector sight may produce a green aim point/image and the second reflector sight may produce a red aim point/image. This has the advantage of reducing the risk of one aim point/image being mistaken for the other, which is advantageous when adjusting the reflector sights or when selecting which reflector sight to use. This is particularly important if the reflector sights are not simultaneously operated.

The sight system may further comprise: a third reflector sight mounted on the sight mount and producing a third aim point/image. The third reflector sight is then positioned in front of the second reflector sight and aligned with the first and second reflector sights, and the third aim point/image is visible through the first and second reflector sights. The third reflector sight may comprise any of the features of the first and second reflector sights. For example, the third reflector sight may be non-magnifying, produce an aim point/image of a different color or shape than the first and second reflector sights, and it may be mounted on the upper part of the abovementioned adjustable sight mount. It is understood that the sight system may comprise any number of additional reflector sights mounted on the sight mount in a similar manner and configuration as the third reflector sight, provided that the additional reflector sights can fit on the sight mount. The additional reflector sights may comprise any of the features of the first and second reflector sights. It is understood that the proposed technology is not limited to the use of two reflector sights in the sight system.

The firearm may have a third setup, or mode of operation. If present, the third reflector sight may then be calibrated with respect to the third setup, or mode of operation. Similarly, the firearm may have any number of additional setups, or modes of operation. If present, the additional reflector sights may then be calibrated with respect to the additional setups, or modes of operation.

In a third setup, or mode of operation, the firearm may be configured for a quick barrel change with a third barrel. The firearm may be configured for a quick barrel change with any number of additional barrels, each corresponding to an additional setup, or mode of operation.

The sight system may further comprise: a viewing instrument mounted on the sight mount and aligned with the first reflector sight and the second reflector sight. The viewing instrument may be a magnifying scope or a night vision device. The viewing instrument being aligned with the first and second reflector sights means that the sightline of a shooter passes through both the viewing instrument and the two reflector sights. Additionally, if the viewing instrument has an optical axis, it means that the optical axes of the viewing instrument and the first and second reflector sights are oriented in the same general direction, or are coaxial.

The viewing instrument may be mounted on the upper part of the sight mount. Additionally or alternatively, the viewing instrument may be releasably mounted on the sight mount.

The first reflector sight and the second reflector sight may be closed sights, or a tube sights. It is understood that the reflector sights may be of the same make and model.

The first reflector sight may have a face facing the second reflector sight, and vice versa. The first reflector sight and the second reflector sight may be mounted at a distance from one another for allowing manual cleaning of the faces of the first and second reflectors. The distance between the first and second reflector sights may be in the range 20 mm to 70 mm, or in the range 30 mm to 50 mm. It has been found that this allows for a compact sight system that can be easily cleaned.

As mentioned above, the sight system may comprise: a tubular seal connecting the first reflector sight and the second reflector sight and configured to prevent light, dirt and/or water from entering there between. The tubular seal may have the additional effect that light reflecting on the second reflector sight, for example sunlight, will not enter the sightline of the shooter.

The tubular seal may allow for the first and second reflector sights to be mounted at a distance from one another, as described above.

The seal may be releasably attached to the first reflector sight and the second reflector sight for allowing a manual removal without tools. The tubular seal may be of an elastomer. This allows for the tubular seal to deform for positioning and removal with the first and second reflector sights mounted on the sight mount. The tubular seal may in itself have a longitudinal length that is greater than the distance between the first and second reflector sights, which has the effect that the tubular seal pushes against the first and second reflector sights and contributes to a sealing there between.

The first reflector sight may have a forward-facing flange, and the second reflector sight may have a backward-facing flange. The forward-facing flange may have a circular or annular shape. Similarly, the backward-facing flange may have a circular or annular shape. The tubular seal may have a first end having a first inner surface matching an outer surface of the forward-facing flange, and the tubular seal may have a second end having a second inner surface matching an outer surface of the backward-facing flange. This allows for a sealing between the tubular seal and the first and second reflector sights. The tubular seal may have only two openings, one at its first end and one at its second end.

The tubular seal may have a circular transverse cross section at each point between the first and second reflector sights. The tubular seal may have a varying diameter along its length. This contributes to a more flexible tubular seal, in particular in the longitudinal direction of the tubular seal, which in extension contributes to an easier positioning and removal of the tubular seal.

Alternatively to the reflector sights being spaced apart and the sight system comprising a tubular seal, the first reflector sight and the second reflector sight may be juxtaposed to one another. The sight system may then further comprise: a gasket between the first reflector sight and the second reflector sight preventing dirt and/or water from entering there between. For example, the gasket may be an O-ring, or a mechanical gasket of an elastomer in the shape of a torus, and the gasket may be pressed between the first and second reflector sights.

BRIEF DESCRIPTION OF THE DRAWINGS

A more complete understanding of the abovementioned and other features and advantages of the proposed technology will be apparent from the following detailed description of preferred embodiments in conjunction with the appended drawings, wherein.

DESCRIPTION OF THE DRAWINGS

Figure 1A:
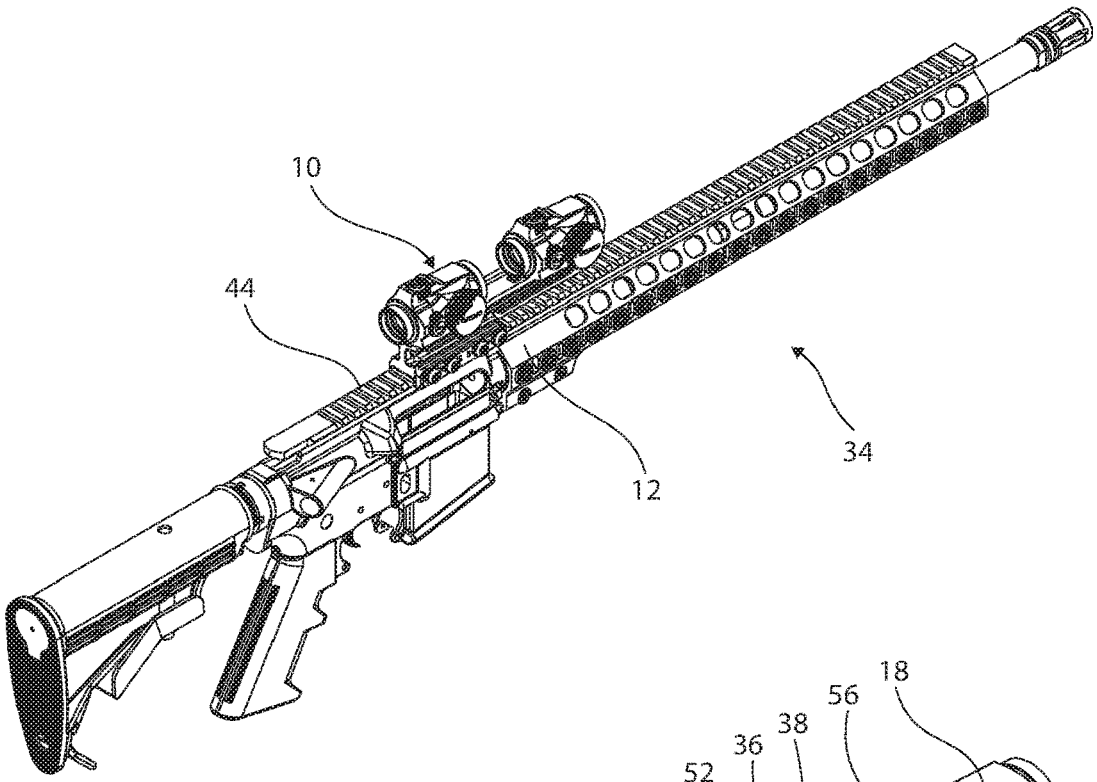
FIG. 1*a* is a perspective view of a firearm fitted with an embodiment of a sight system.
Figure 1B:
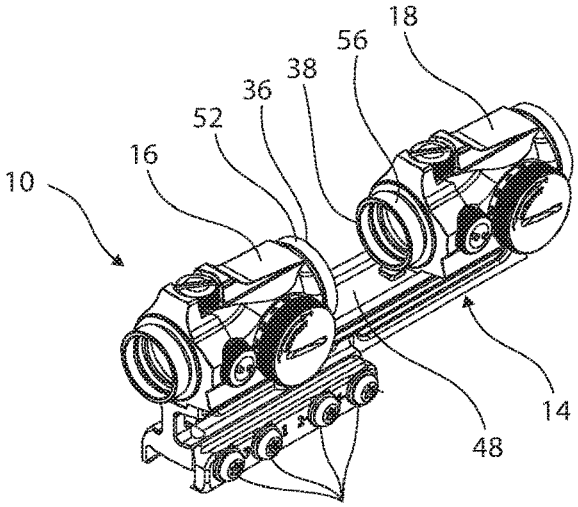
FIG. 1*b* is a perspective view of the sight system shown in FIG. 1*a*.

A perspective view of a firearm 12 fitted with an embodiment of a sight system 10 is shown in FIG. 1*a*. The sight system 10 as such is shown in FIG. 1*b*. The sight system 10 has a sight mount 14, a first reflector sight 16, and a second reflector sight 18. The reflector sights 16 and 18 can function independently from one another. For example, each has an internal battery and one can be operated while the other is turned off.

The firearm 12 is an assault rifle having a Picatinny rail 44 at its upper side. The sight mount 14 is releasably attached to the Picatinny rail by way of a number of screws 46. This means that a quick change of the sight system 10 as such is not possible.

The sight mount 14 has an upper rail 48 and the first reflector sight 16 and the second reflector sight 18 are attached to the upper rail 48. This way, the two reflector sights 16 and 18 are fixed relative to one another and oriented to shoot in the same general direction. The second reflector sight 18 is positioned in front of and aligned with the first reflector sight 16.

Both reflector sights 16 and 18 are closed non-magnifying reflector sights. The first aim point of the first reflector sight 16 and the second aim point of the second reflector sight 18 are visible through the first reflector sight 16. Each of the reflector sights 16 and 18 produces a single reticle in the form of an aim-point. The aim point of the first reflector sight 16 is red in color, while the aim point of the second reflector sight 18 is green in color.

The reflector sights 16 and 18 are attached to the upper rail 48 by way of a number of screws (not shown). This means that a quick change of the reflector sights 16 and 18 as such is not possible.

The first reflector sight 16 has been calibrated with respect to a first ammunition type producing subsonic muzzle velocities when shot by the firearm 12, and the second reflector sight 18 has been calibrated with respect to a second ammunition type producing supersonic muzzle velocities when shot by the firearm 12. The two different types of ammunition produce different groupings at a specific distance. In an alternative embodiment, the first reflector sight 16 is calibrated with respect to the supersonic ammunition, while the second reflector sight 18 is calibrated with respect to the subsonic ammunition.

Figure 1D:
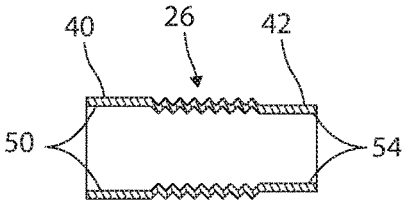
FIG. 1*d* is a cross-sectional view of the tubular seal shown in FIG. 1*c*, FIGS. 2*a-b* are side and perspective views of an embodiment of an adjustable sight mount.
Figure 1C:
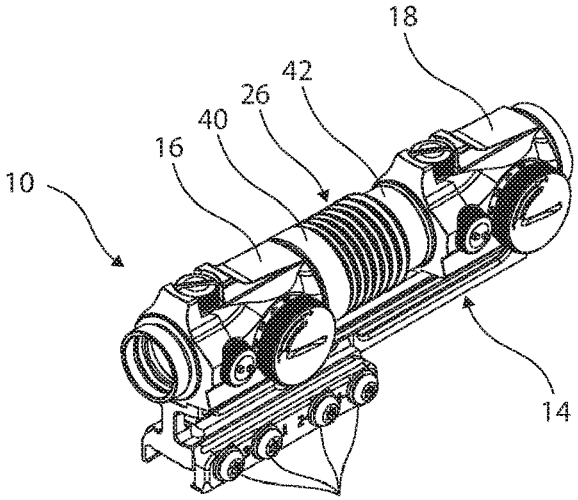
FIG. 1*c* is a perspective of an embodiment in which the sight system shown in FIG. 1*b* is fitted with a tubular seal.

FIG. 1*c* shows a perspective view of an embodiment in which the embodiment described in relation to FIG. 1*b* is fitted with a tubular seal 26. A cross-section of the tubular seal is shown in FIG. 1*d*.

The reflector sights 16 and 18 are spaced apart approximately 35-45 mm and the tubular seal 26 bridges the gap between them. The tubular seal 26 is made of an elastomer and is deformable in both the transverse and the longitudinal direction. It is also longer than the gap between the reflector sights 16 and 18 and the tubular seal 26 therefore press and seal against the reflector sights 16 and 18. The tubular seal 26 is releasably attached to the reflector sights 16 and 18 and can be removed without tools.

The first reflector sight 16 has a circular forward-facing flange 36 and the second reflector sight 18 has a circular backward-facing flange 38. The tubular seal 26 has a circular transverse cross-section with a diameter that varies along its length. The tubular seal 26 has only two openings, one at the first end 40 and one at the second end 42. It has a first inner surface 50 at the first end 40 that matches a first outer surface 52 of the forward-facing flange. Similarly, it has a second inner surface 54 at the second end 42 matching an outer surface 56 of the backward-facing flange 38. Additionally, the inner diameter of the inner surfaces 50 and 54 is slightly smaller than the outer diameter of the corresponding matching outer surfaces 52 and 56. This in combination with the tubular seal being of an elastomer allows for a sealing between the tubular seal 26 and the first and second reflector sights 16 and 18.

Figure 2A:
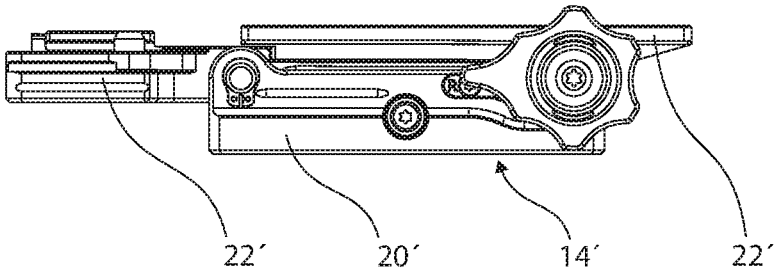
Figure 2B:
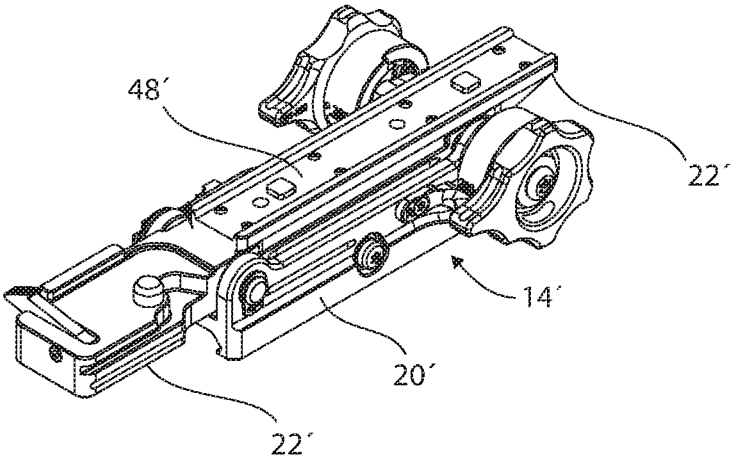
Figure 3A:
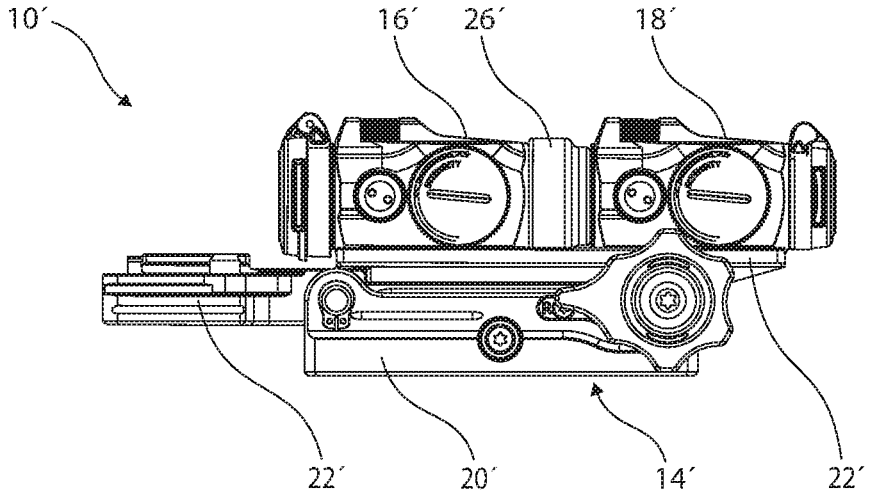
FIG. 3*a-b* are side and perspective views of an embodiment of a sight system in which the adjustable sight mount shown in FIGS. 2*a-b* is fitted with first and second reflector sights with a tubular seal between them.
Figure 3B:
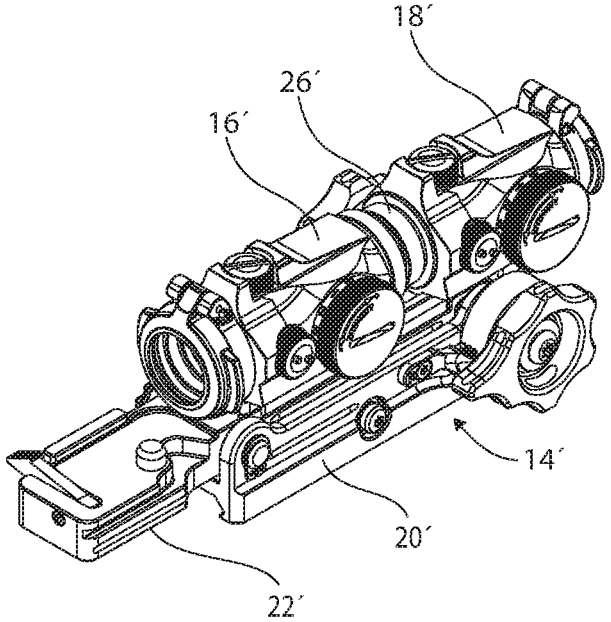
Figure 4A:
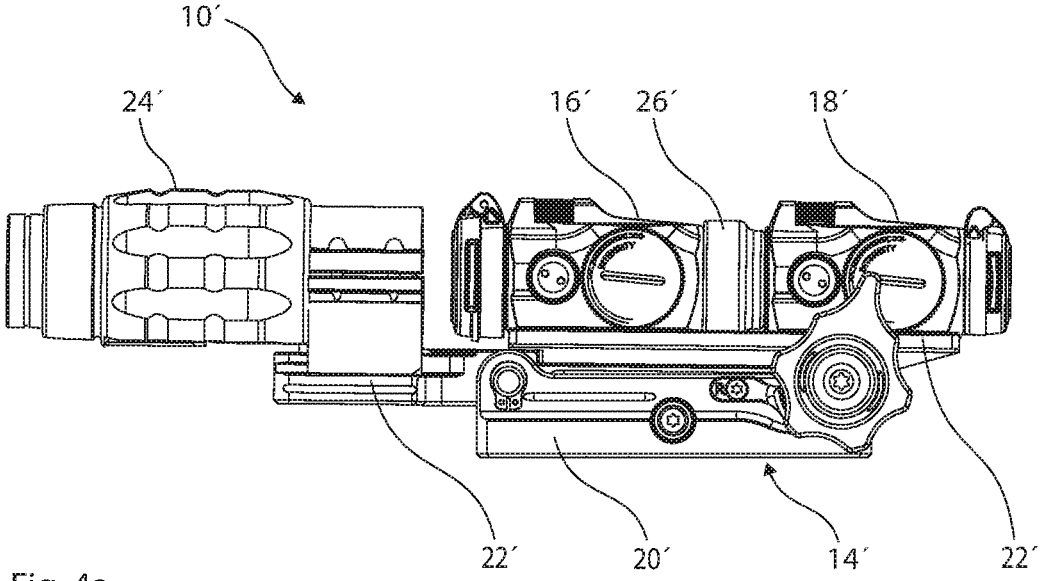
FIG. 4*a-b* are side and perspective views of an embodiment of a sight system in which the sight system shown in FIGS. 3*a-b* is further fitted with a viewing instrument.
Figure 4B:
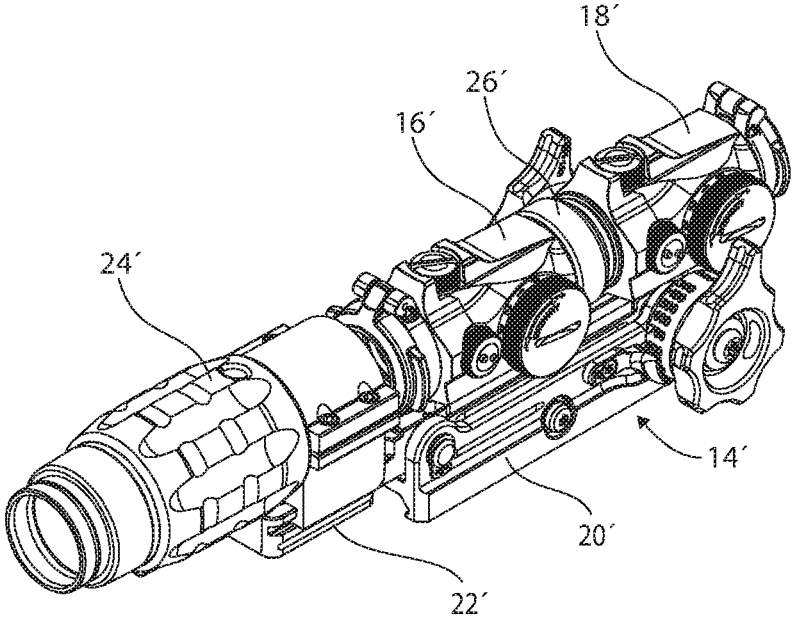
Figure 5:
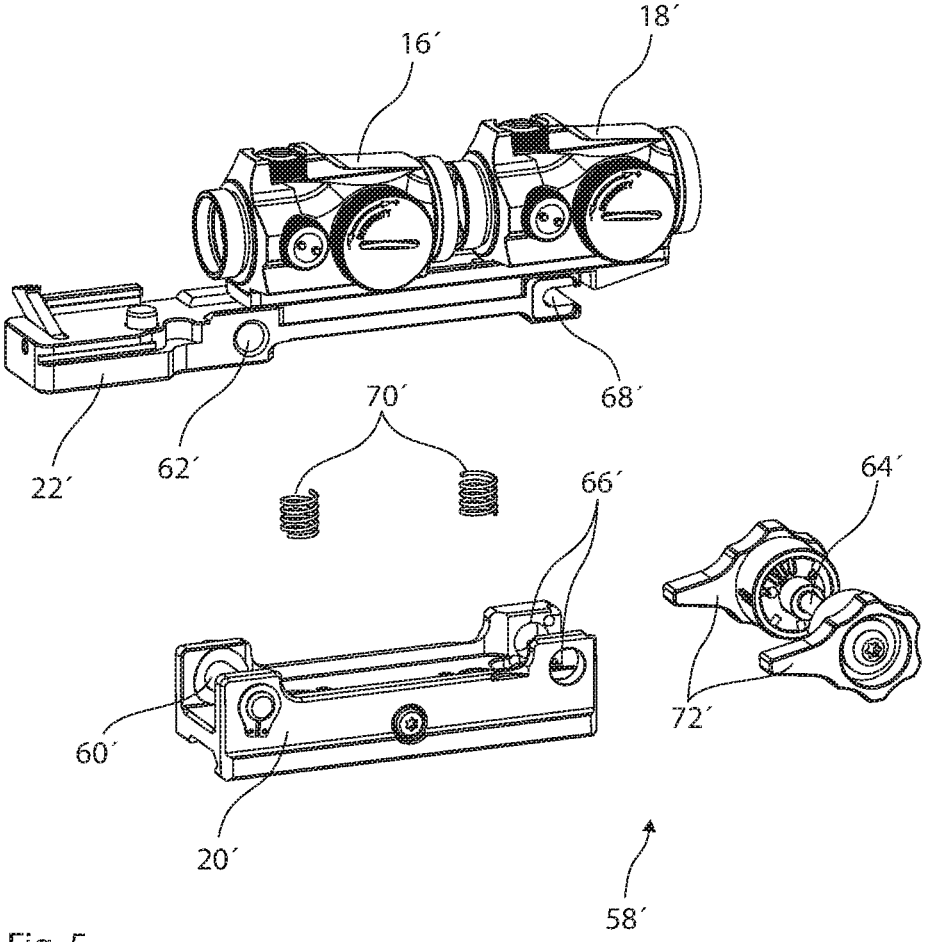
FIG. 5 is an exploded view of an embodiment of a sight system showing the principal parts of an adjustable sight mount.

An embodiment of an adjustable sight mount 14' is shown in FIGS. 2*a-b*. An embodiment of a sight system 10' using the adjustable sight mount 14' is show in FIGS. 3*a-b*. An embodiment of a sight system 10' further using a viewing instrument 24' in the form of a night vision device is shown in FIGS. 4*a-b*. An embodiment of a sight system 10' similar to that of FIGS. 3*a-b* is shown in FIG. 5, with the principal difference that the sight system 10' has no tubular seal. This means that the adjustable sight mounts 14' of the embodiments shown in FIGS. 2-4 have the same principal function as the adjustable sight mount 14' shown in FIG. 5.

The sight mount 14' has a lower part 20', an upper part 22', and a selector 58'. The lower part 20' is intended to be attached to a firearm and the upper part 22' is intended to carry reflector sights and optical instruments. The upper part 22' is pivotally connected to the lower part 20' by way of a pivot joint formed by a transverse shaft 60' attached to the lower part 20' and a transverse bore 62' in the upper part 22'. The selector 58' is formed by a transverse selector shaft 64' that is eccentric with respect to two transverse selector bores 66' in the lower part 20'. A handle 72' is attached at either end of the selector shaft 64' allowing a manual rotation of the selector 58'. The upper part 22' forms an abutment surface 68' facing away from lower part 20'. Two coil springs 70' biases the upper part 22' with respect to the lower part 20' and presses the abutment surface 68' against the selector shaft 64'. This way, the selector 58' is configured to set the upper part 22' at different angular positions or elevations relative to the lower part 20' by rotation of one of the handles 72'. When mounted on a firearm, the different elevations compensates for different shooting distances. In the embodiment shown in FIGS. 4*a-b* the handle 72' is rotated such that the eccentric selector shaft 64' pushes the upper part 22' further down than in the embodiment shown in FIGS. 3*a-b*, thus setting the a adjustable sight mount 14' to shoot at a longer distance.

The upper part 22' has an upper rail 48' similar to that of the embodiments described in relation to FIGS. 1*a-d*. The reflector sights 16' and 18' are attached to the upper rail 48' and function in the same manner as in the previous embodiments. However, the reflector sights 16' and 18' are positioned closer to one another and the tubular seal 26 between them is shorter in length. It should be noted that there is no tubular seal in the embodiment shown in FIG. 5.

In the embodiments shown in FIGS. 4*a-b* the sight system 10' further has a viewing instrument 24' in the form of a night vision device. It is aligned with the first reflector sight 16' and the second reflector sight 18'. The viewing instrument 24' is releasably mounted on the upper part 22 of the sight mount 14'.

Figure 6:
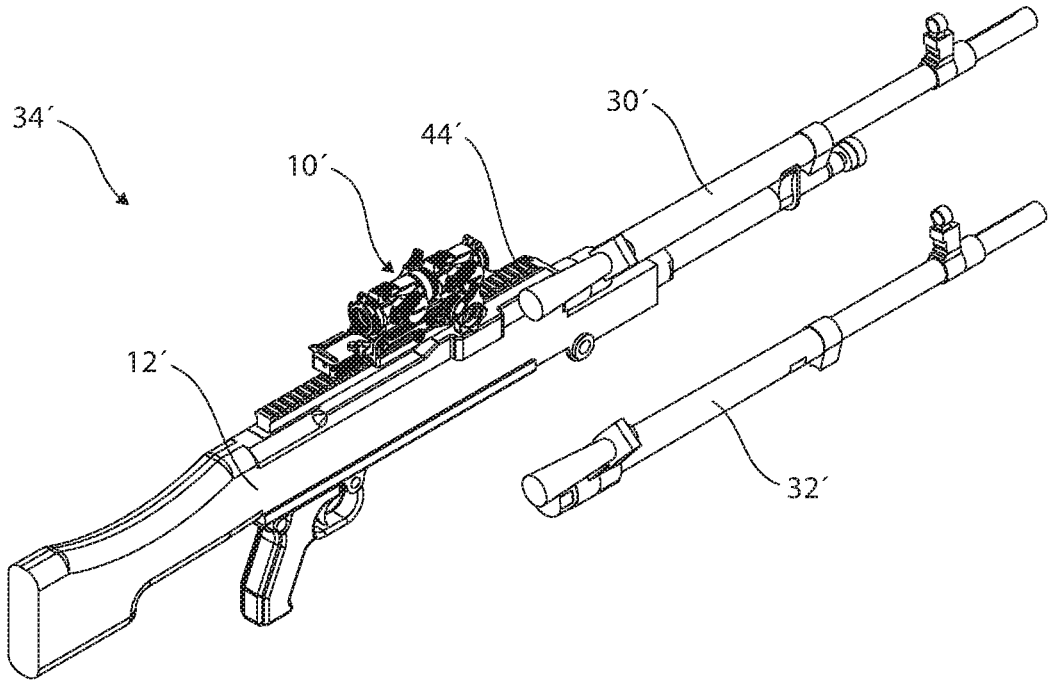
FIG. 6 is a perspective view of a firearm fitted with the sight system described in relation to FIGS. 3*a-b*.
Figure 7:
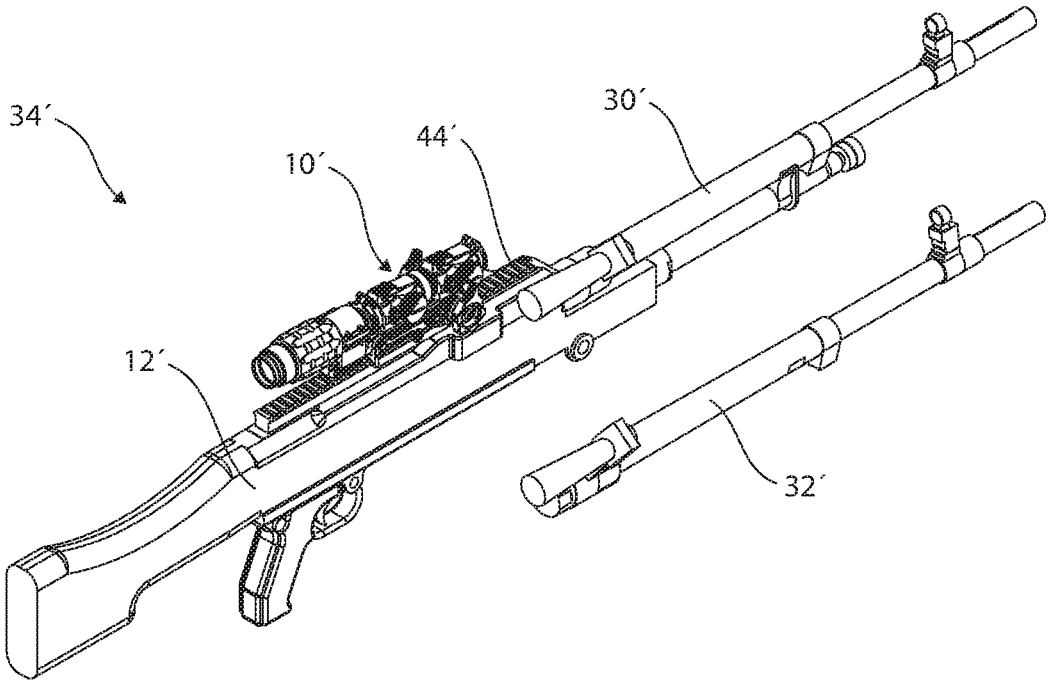
FIG. 7 is a perspective view of a firearm fitted with the sight system described in relation to FIGS. 4*a-b*.

FIG. 6 is a perspective view of a firearm 12' in the form of a GPMG fitted with the sight system 10' described in relation to FIGS. 3*a-b*. FIG. 7 is a perspective view of the same firearm 12' fitted with the sight system 10' described in relation to FIGS. 4*a-b*, i.e. including a viewing instrument. The lower part 20' of the sight mount 14' is releasably attached to a Picatinny rail 44' mounted on firearm 12'.

The firearm 12' is configured for a quick barrel change between a first barrel 30' and a second barrel 32'. When fitted with the first barrel 30' the firearm 12' operates in a first mode, and when fitted with the second barrel 32' the firearm 12' operates in a second mode. The different barrels 30' and 32', or modes of operation, produce different groupings at a specific distance and with the same type of ammunition. A shooter can then calibrate the first reflector sight 16' such that its reticle overlays the geometric center of the groupings produced by the first barrel 30'. Similarly, the shooter can calibrate the second reflector sight 18' such that its reticle overlays the geometric center of the groupings produced by the second barrel 32'. This way the first reflector sight 16' is calibrated with respect to the first mode of operation, and the second reflector sight 18' is calibrated with respect to the second mode of operation.

ITEM LIST

10 sight system
12 firearm
14 sight mount
16 first reflector sight
18 second reflector sight
20 lower part of sight mount
22 upper part of sight mount
24 viewing instrument
26 tubular seal
30 first barrel
32 second barrel
34 weapon system
36 forward-facing flange
38 backward-facing flange
40 first end of tubular seal
42 second end of tubular seal
44 Picatinny rail of firearm
46 screws
48 upper rail of sight mount
50 first inner surface
52 first outer surface
54 second inner surface
56 second outer surface
58 selector
60 pivot shaft
62 transverse bore
64 selector shaft
66 selector bores
68 abutment surface
70 coil spring
72 handle

The invention claimed is:

1. A sight system for a firearm comprising:

a sight mount configured to be attached to the firearm, a first reflector sight mounted on the sight mount and producing a first aim point/image, a second reflector sight mounted on the sight mount and producing a second aim point/image, wherein the second reflector sight is positioned in front of and aligned with the first reflector sight, and the first aim point/image and the second aim point/image are visible through the first reflector sight, wherein the firearm has a first mode of operation and a second mode of operation, and wherein:

the first reflector sight is calibrated with respect to the first mode of operation, and the second reflector sight is calibrated with respect to the second mode of operation.

2. The sight system according claim 1, wherein the firearm is configured for a barrel change between a first barrel and a second barrel, the first mode of operation is with the first barrel fitted on the firearm, and the second mode of operation is with the second barrel fitted on the firearm.

3. The sight system according to claim 1, wherein the first reflector sight and the second reflector sight are operationally independent from one another.

4. The sight system according to claim 1, wherein the first reflector sight and the second reflector sight produce aim points/images of different colors, shapes, and/or intensities.

5. The sight system according to claim 1, wherein:

the sight mount is adjustable and comprises a lower part, an upper part, and a selector, the lower part is configured to be attached to the firearm, the upper part is pivotally connected to and biased with respect to the lower part, and the selector is configured to set the upper part at different angular positions relative to the lower part corresponding to different shooting distances, and wherein the first reflector sight and second reflector sight are mounted on the upper part.

6. The sight system according to claim 1 further comprising:

a viewing instrument aligned with the first reflector sight and the second reflector sight.

7. The sight system according to claim 1, wherein the first reflector sight and the second reflector sight are mounted at a distance from one another for allowing manual cleaning of the face of the first reflector facing the second reflector, and vice versa.

8. The sight system according to claim 1, wherein the sight system further comprises:

a tubular seal connecting the first reflector sight and the second reflector sight configured to prevent light, dirt and/or water from entering there between.

9. The sight system according to claim 1, wherein the first reflector sight and the second reflector sight are juxtaposed to one another.

10. Use of a sight system according to claim 1 for compensating for a change of setup, or mode of operation.

11. A method for calibrating a sight system according to claim 1 mounted on a firearm having a first setup, or mode of operation, and a second setup, or mode of operation, wherein the method comprises:

calibrating the first reflector sight with respect to the first setup, or mode of operation, and calibrating the second reflector sight with respect to the second setup, or mode of operation.

* * * * *